US005497685A

United States Patent [19]

Mohr

[11] Patent Number: 5,497,685

[45] Date of Patent: Mar. 12, 1996

[54] APPARATUS FOR OPTIMIZING CUTTING OF STACKED SHEETS OF MATERIAL IN A CUTTING MACHINE

[76] Inventor: Wolfgang Mohr, Hundshager Weg 42, D-65719, Hofheim/Taunus, Germany

[21] Appl. No.: 112,892

[22] Filed: Aug. 27, 1993

[30] Foreign Application Priority Data

Aug. 28, 1992 [DE] Germany ..... 42 28 650.6

[51] Int. Cl.[6] ..... B26D 7/04

[52] U.S. Cl. ..... 83/282; 83/364; 83/365; 83/461; 83/466

[58] Field of Search ..... 83/72, 74, 248, 83/282, 361, 365, 375, 452, 461, 466, 934, 364, DIG. 1

[56] References Cited

U.S. PATENT DOCUMENTS 2,971,417 2/1961 Chlebus ..... 83/364
3,182,542 5/1965 Cochran ..... 83/466 X
4,757,731 7/1988 Mohr ..... 83/72 X
4,836,074 6/1989 Mohr ..... 83/282 X

FOREIGN PATENT DOCUMENTS 3116292 11/1982 Germany .

*Primary Examiner*—Richard K. Seidel
*Assistant Examiner*—Raymond D. Woods
*Attorney, Agent, or Firm*—Max Fogiel

[57] ABSTRACT

An arrangement for cutting stacked sheets of material resting on a bench. A hydraulically actuated holdfast beam descends onto the material to be cut, and the cutter travels perpendicular to the surface of the bench adjacent to the holdfast beam. A sensor operates during the cutting in conjunction with a circuit that controls the holdfast beam, and emits a signal to reduce the beam's holdfast force. The sensor is mounted below the holdfast beam and outside its effective surface that comes into contact with the material being cut. The distance between the sensor and the effective surface of the holdfast beam equals the distance between a lower edge of the holdfast beam and an upper edge of the stacked material that is being cut.

6 Claims, 3 Drawing Sheets

APPARATUS FOR OPTIMIZING CUTTING OF STACKED SHEETS OF MATERIAL IN A CUTTING MACHINE

BACKGROUND OF THE INVENTION

The present invention concerns a method of and device for optimizing the cutting indication in a machine that cuts material, especially stacked sheets of paper, cardboard, etc.

German 3 116 292 A1 discloses a method of optimizing the cutting indication in a material-cutting machine. A hydraulically actuated beam descends on the sheets of material stacked on a bench to hold the material fast before it is cut and the beam's holdfast force is reduced before the beam descends onto the material.

During cutting indication the holdfast beam descends onto the material to be cut to monitor the course of the cut and correct any error in the orientation of the stack. The known material-cutting machine has a special switch that reduces the compression of the hydraulic fluid and hence the beam's holdfast force in order to prevent injury in the event an operator's finger intervenes between the holdfast beam and the stack during cutting indication and simultaneous correction of the stack's orientation. Safety regulations provide that the beam's holdfast force be no more powerful during cutting indication than 500N. The beam's holdfast force can accordingly be reduced even further in the known material-cutting machine in order to completely rule out any risk to the operator. The machine includes for this purpose two pressure-regulating valves, one that limits the compression of the hydraulic fluid to maintain the beam's holdfast force at no more than 500N and the other inside a compressor. Associated with the mechanism that actuates the cutting indication is an electric circuit that in order to protect the operator while the material is being cut, activates a light barrier in the machine. When the light across the light barrier is interrupted, the circuit generates a signal that deactivates the first valve and activates the second, preferably limiting the force on the holdfast beam to 100N. The holdfast beam descends at high speed as long as the light barrier is not interrupted, although the static and dynamic cutting-indicator forces are low and the descent of the holdfast beam is slow when operations are conducted below the holdfast beam.

One drawback to the aforesaid material-cutting machine is that the holdfast beam descends slowly and with diminished force while the operator is working in the vicinity of the light barrier that is conventionally present in material-cutting machines. It should basically be attempted on the other hand to ensure that the holdfast beam comes to rest gently against the stack, especially when the sheets are thin. Aside from that, it is also considered a drawback from the aspect of minimizing the unproductive motions of the holdfast beam for the rate of the holdfast beam's descent to be initiated by the light barrier, which is so far from the holdfast beam and the blade, leading to premature deceleration of the descent when the light barrier engages.

SUMMARY OF THE INVENTION

The object of the present invention is a method of and device for optimizing the cutting indication.

The method of optimizing the cutting indication in a material-cutting machine with a hydraulically actuated holdfast beam that descends with decreasing force before they are cut onto the sheets of material stacked on the machine's bench is characterized in that a definite distance between the holdfast beam and the material to be cut is determined while the holdfast beam is descending onto the material and the beam's holdfast force is reduced while the definite distance is being determined or after the definite distance has been determined.

The beam's holdfast force is reduced once the holdfast beam is at a prescribed distance from the material to be cut. It is of particular significance in this context for the position of the holdfast beam to be oriented in accordance with the height of the stack of already cut material. If for example the maximal possible height of the stack of material to be cut is 165 mm and its actual height only 30 mm and if the beam's holdfast force is to be reduced when the beam is 10 mm for example from the material to be cut, this situation corresponds to a reduction in the beam's holdfast force at 40 mm from the surface of the bench that the material is stacked on. If the height of the stack is 70 mm for example, the beam's holdfast force will be reduced while the holdfast beam is still 80 mm from the surface of the bench. Only the distances between the effective surface of the holdfast beam and the top, which faces it, of the stack are determined in accordance with the invention accordingly. It is considered of advantage for the beam's holdfast force to be reduced directly after the distance between the holdfast beam and the stack of material has been determined. It is, however, also possible to interpose a timer into the hydraulics circuitry that will slightly delay the beam's holdfast force once the definite distance has been determined.

It is of advantage for the beam's holdfast force to be reduced when the holdfast beam is 10 to 20 mm from the material to be cut. This feature ensures that the holdfast beam approaches the material to be cut at a high speed that will be reduced far enough from the material to be cut to eliminate injuries due to extremities being caught in the machinery and allow the holdfast beam to descend the rest of the distance to the material to be cut at a lower speed.

The definite distance between the lower edge of the holdfast beam and the upper edge of the stack of material being cut is determined in accordance with another particular characteristic by a pick-up mounted stationary on the holdfast beam and preceding it in its descent. Since it is mounted stationary on the holdfast beam, it will travel the same route and, due to its precedence, sense the position of the upper edge of the stack of material being cut. Once the pick-up has detected the upper edge of the stack of material being cut, the beam's holdfast force will be reduced immediately or subsequently. In addition to continuous determination of the relative positions of the lower edge of the holdfast beam and the upper edge of the stack of material being cut, it is also possible to determine their positions discontinuously by providing several stationary determination sites, by means of which the position of the holdfast beam, especially its lower edge, and that of the upper edge of the stack of material being cut can be determined. The several stationary determination sites makes it possible in accordance with the precision of the distances between adjacent determination sites to obtain information as to the particular height of the stack, meaning the distance between the upper edge of the stack of material being cut and the surface of the bench and the distance between a mark on the holdfast beam and in particular on the lower edge of the holdfast beam and the surface of the bench or the uppermost position of the holdfast beam so that conclusions can be drawn from that dimension as to the distance between the lower edge of the holdfast beam and the upper edge of the stack of material being cut. Once the holdfast beam and the stack of material being cut are at the definite distance, the beam's holdfast force will be reduced immediately or subsequently.

A preferred device for cutting stacked sheets of material and with optimized cutting indication includes a bench for the material to be cut to rest on, a mechanism that advances the material being cut, a hydraulically actuated holdfast beam that descends onto the material to be cut, a cutter that travels perpendicular to the surface of the bench adjacent to the holdfast beam, and a sensor operating during the cutting indication in conjunction with a circuit that controls the holdfast beam and emitting when in operation a signal that leads to reduction of the beam's holdfast force. This device is characterized in that the sensor is mounted below the holdfast beam and outside its effective surface, the surface that comes into contact with the material being cut, that is, and the effective distance between the sensor and the effective surface of the holdfast beam equals the definite distance between the lower edge of the holdfast beam and the upper edge of the stack of material being cut at which the beam's holdfast force is reduced immediately or subsequently. In this embodiment of the device, in which the sensor is displaced along with the holdfast beam, the sensor will preferably include one component at one end of the holdfast beam and another component at the other end of the holdfast beam. The sensor will accordingly accommodate the stack to be cut between the two components. The sensor can be of various types, a light barrier with a source of light and a photocell for example.

It is convenient for the sensor to be positioned not only outside the holdfast beam but also outside the surface of the bench. The holdfast beam can accordingly descend to the surface of the bench without the surface, if of the conventional type, damaging the sensor. It would basically alternatively be possible to position the sensor above the bench surface and remove some of the surface to accommodate the sensor where it would collide with the surface when the holdfast beam is all the way down. It would in this case be necessary of course to keep any material being cut out of the range of the sensor.

Another preferred embodiment of the device for cutting stacked sheets of material and with optimized cutting indication includes instead of one sensor mounted on the holdfast beam several sensors mounted in the guillotine bent that the holdfast beam travels up and down in at various distances from the surface of the bench, whereby each sensor acts parallel to the surface of the bench, for determination of the current level of the upper edge of the stack of material being cut and of the lower edge of the holdfast beam relative to the surface of the bench by means of the sensors, whereby the beam's holdfast force is reduced immediately or subsequently at a definite-distance level of non-actuated sensors. The sensors associated with the stack of material being cut are accordingly actuated in accordance with the height of that stack and the sensors associated with the holdfast beam in accordance with the position of the beam. The number of non-actuated sensors in the column represents the distance between the lower edge of the holdfast beam and the upper edge of the stack of material being cut, whereby the resulting precision or lack of precision of the measurement is to be taken into consideration by way of the distance between adjacent sensors. It is convenient for the sensors in this embodiment of the invention as well to be light barriers that accommodate the material to be cut between two components as hereintofore specified.

Further characteristics of the invention will be evident from the following specification and figures. All characteristics and combinations thereof are essential to the invention.

BRIEF DESCRIPTION OF THE DRAWINGS

Two embodiments of the invention will now be specified by way of example and without being limited to them in any way with reference to the drawing, wherein.

DESCRIPTION OF THE PREFERRED EMBODIMENTS

Figure 1:
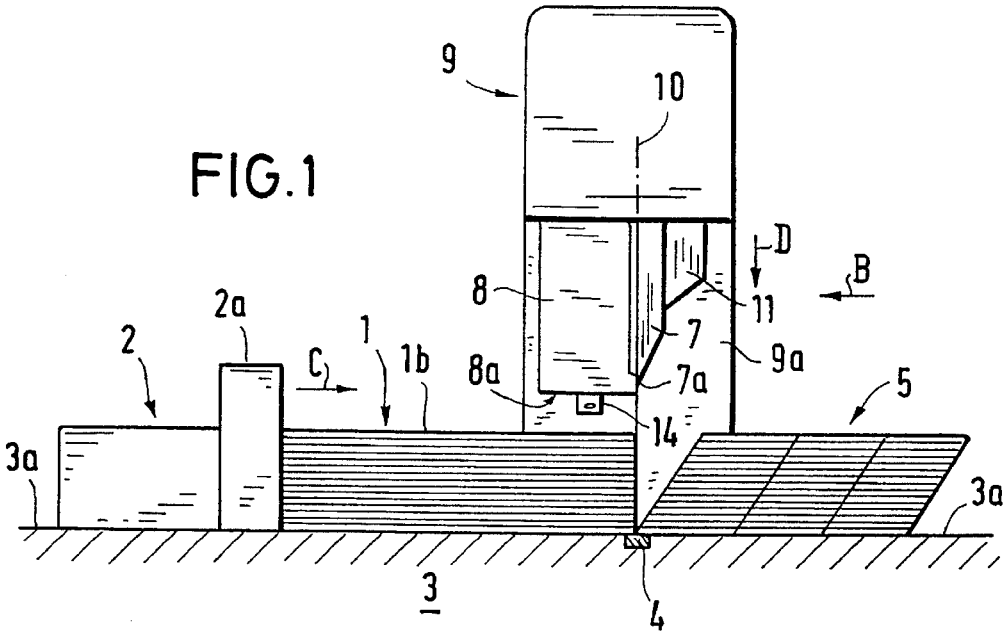
FIG. 1 is a schematic section along the line A—A in FIG. 2 through the top of a machine that cuts stacks of material, whereby the holdfast beam has a light barrier.
Figure 2:
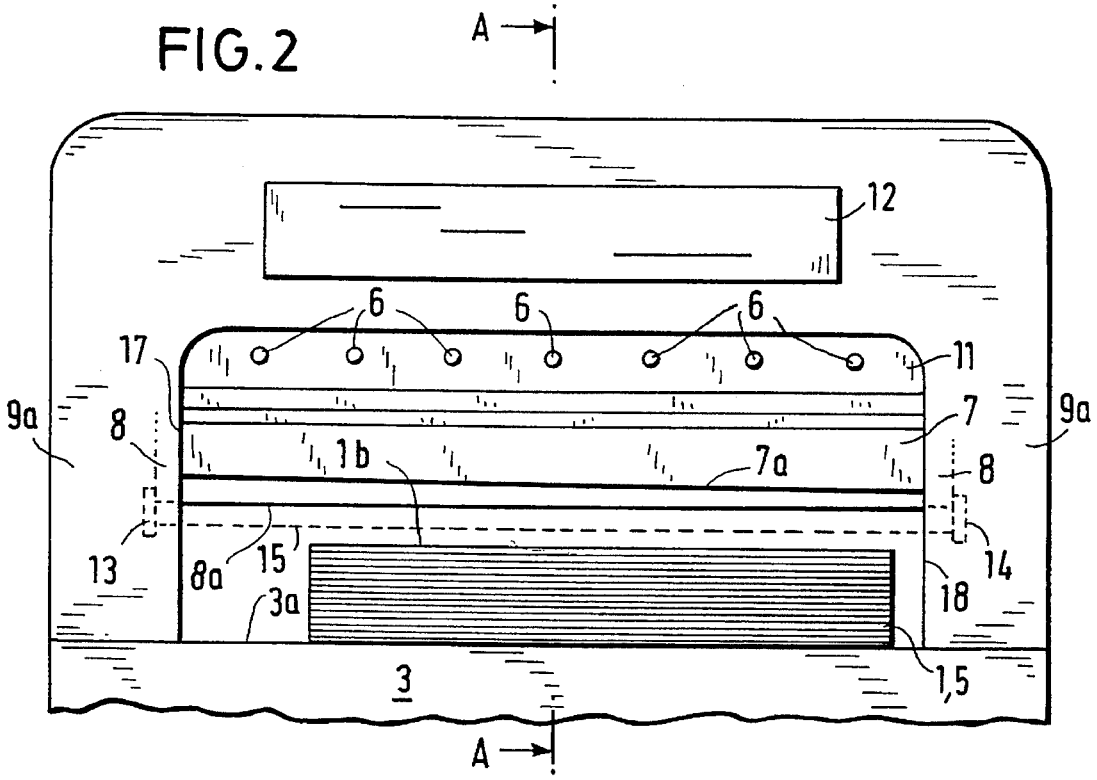
FIG. 2 is a front view of the machine from the direction indicated by arrow B in FIG. 1.
Figure 3:
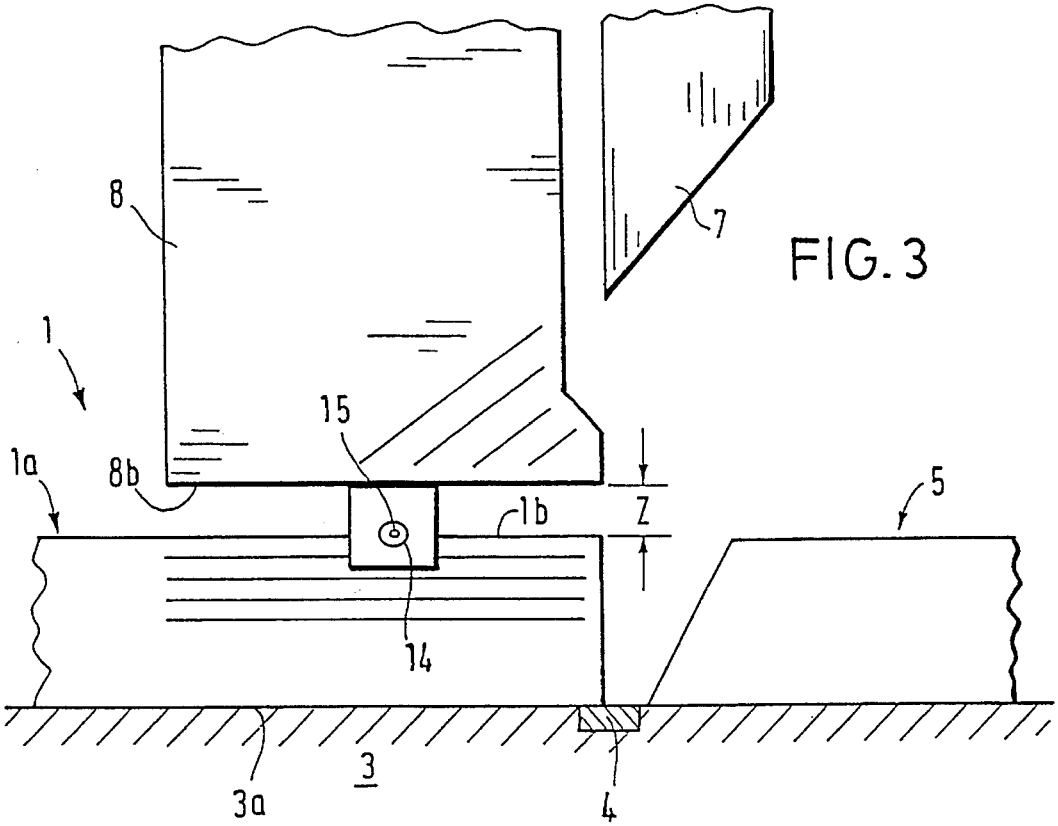
FIG. 3 is a detail of the actual material-cutting point in the machine illustrated in FIG. 1 with a low stack.
Figure 4:
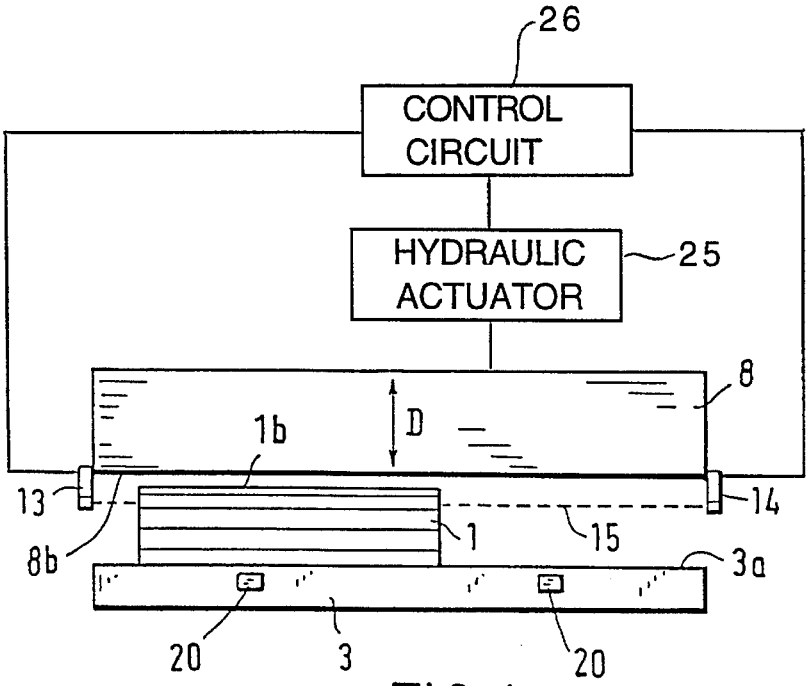
FIG. 4 is a front view of the components of the machine relevant to the method in accordance with the invention.

FIGS. 1 and 2 are highly schematic illustrations of the top of a guillotine-type machine for cutting material, especially stacked sheets of paper, cardboard, or similar material. The machine rests on an unillustrated base. The base accommodates a bench 3 for the stack to rest on and a guillotine bent 9. Embedded in and extending all the way across bench 3 is a blade-edge protector 4. Also extending all the way across the bench is a material-advancing mechanism 2 with a thruster 2*a*. Thruster 2*a* can be forwarded in the direction indicated by arrow C to produce the overall motion of the material while it is being cut. Upstream of blade-edge protector 4, the material 1 that is to be cut rests on the surface 3*a* of bench 3 and against thruster 2*a*. Downstream of blade-edge protector 4 is the material 5 that has been cut, in the form of three advanced stacks. Above blade-edge protector 4 is a blade 7, which is illustrated raised in FIGS. 1 and 2 and can descend as far as blade-edge protector 4 in the direction indicated by arrow D. Adjacent to blade 7 on the side facing material-advancing mechanism 2 is a holdfast beam 8, which is also illustrated raised in FIGS. 1 and 2 and can descend onto the material 1 that is to be cut. Blade 7 and holdfast beam 8 are accommodated in the machine's bent 9, which surrounds them at the top and sides. Blade 7 is fastened by screws FIG. 6 to a blade holder 11 in the form of a beam. The sharp edge 7*a* of blade 7 is at a slight angle to the horizontal. An unillustrated crankshaft moves blade 7 in an oblique shearing stroke in accordance with a known procedure. Holdfast beam 8 is mounted with each end in one of the uprights 9*a* of bent 9 and can be moved up and down therein in the direction indicated by arrow D by a hydraulic drive 25. Blade 7 separates the material along a plane 10 perpendicular to the surface 3*a* of bench 3 and extending through blade-edge protector 4. The machine is controlled from a panel 12.

The known embodiment of a guillotine-type machine hereintofore specified and illustrated in FIGS. 1 through 4 has a sensor in the form of a light barrier comprising a source 13 of light and a photocell 14 below the material-contact surface 8*a* of holdfast beam 8. Source 13 of light and photocell 14 are positioned at opposite ends of holdfast beam 8 and accordingly beyond its material-contact surface 8*a*. Source 13 of light, photocell 14, and holdfast beam 8 are represented in FIG. 2 by broken lines in the vicinity of the uprights 9*a* of bent 9. The light 15 emitted by source 13 of light extends horizontally at a specific distance Z below the material-contact surface 8*a* of holdfast beam 8.

The light barrier is connected by electric circuitry 26 during the state of operation of cutting indication, which can be initiated by two buttons 20 in the front of the bench, to the hydraulics that control holdfast beam 8. When the light barrier is actuated, when, that is, light 15 is interrupted, it controls the holdfast-beam hydraulic system, decreasing the beam's holdfast force. This reduction in the beam's holdfast force can occur as soon as light 15 is interrupted or later, meaning that, when light 15 is interrupted, a timer is actuated that reduces the beam's holdfast force subsequent to a specific interval after the interruption of light 15. Since the light 15 in the light barrier precedes the material-contact surface 8*a* of holdfast beam 8 at effective distance Z in the direction the beam moves in, the signal to immediately or subsequently reduce the beam's holdfast force will not be emitted until the distance between the material-contact surface 8*a* of holdfast beam 8, which is also the lower edge 8*b* of holdfast beam 8, and the top 1*a* of the material 1 that is to be cut, which is also the upper edge 1*b* of the stack of material 1 being cut equals effective distance Z.

The distance between light barrier 15 and the lower edge 8*b* of holdfast beam 8 in the illustrated example is 10 mm. If the light barrier is designed to ensure that emitting the signal will immediately reduce the beam's holdfast force, the reduction will occur when holdfast beam 8 is 10 mm from the material 1 to be cut. If a timer is also included, dimension Z will be greater, ensuring that the beam's holdfast force is reduced before the beam can injure the operator.

Figure 5:
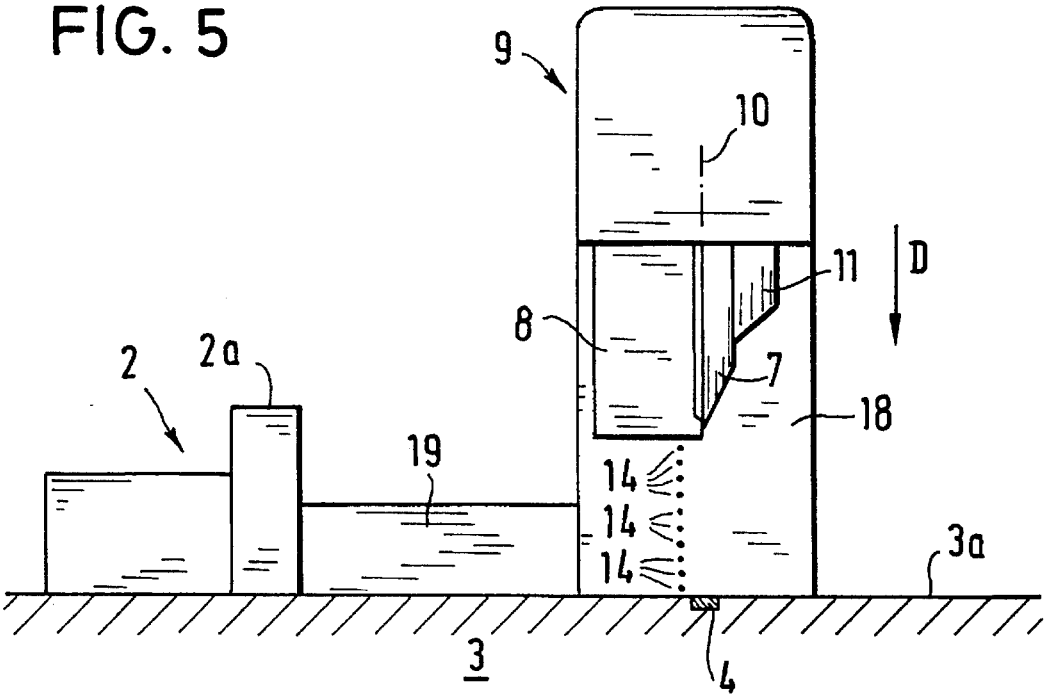
FIG. 5 is a section similar to FIG. 1 of a machine with several light barriers in its bent.

FIG. 5 illustrates another embodiment with several horizontally active light barriers in the vicinity of the inner surfaces 17 and 18 of bent 9 instead of a single horizontally acting light barrier secured to the bottom of holdfast beam 8 (cf. also FIG. 2). The material is, in order to facilitate comprehension of the overall machine, not illustrated. Mounted on bench 3 is a lateral baffle. FIG. 5 illustrates a column of uniformly distributed photocells 14. There are similar sources of light distributed along the inner surface 17 of bent 9. When a stack of material 1 is positioned for cutting on the surface 3*a* of bench 3, one or more of the light barriers associated with holdfast beam 8 will be actuated in accordance with the height of the stack. As holdfast beam 8 descends in the direction indicated by arrow D, it will actuate one or more light barriers depending on how far it travels, more light barriers being actuated the farther it descends, decreasing the number of non-actuated light barriers above the material 1 to be cut and below the material-contact surface 8*a* of holdfast beam 8. The number of not actuated light barriers represents the distance between the holdfast beam 8 and the top 1*a* of the material 1 that is to be cut. The electric circuitry that operates in conjunction with the hydraulic system actuating holdfast beam 8 is designed in this embodiment such that in the presence of a definite distance, meaning in the event that a section of light barriers representing distance Z as a definite distance is not actuated, the beam's holdfast force will be reduced immediately or subsequently. Components similar to those illustrated in FIGS. 1 through 4 are labeled with the same numbers in FIG. 5, and the various embodiments function similarly unless otherwise specified.

Once the material has been cut, blade 7 will return to its upper and disengaged position ahead of holdfast beam 8 and, once the total stack has been processed, material-advancing mechanism 2 will return to its starting position opposite the direction indicated by arrow C.

I claim:

1. An arrangement for cutting stacked sheets of material, comprising: a bench with a planar surface for supporting the material to be cut; means for advancing the material to be cut; a hydraulically actuated holdfast beam with a holdfast force and an effective surface descending onto the material to be cut; a cutter traveling perpendicular to the surface of said bench adjacent to said holdfast beam; a sensor operating during a cutting operation in conjunction with a circuit controlling said holdfast beam and emitting when in operation a signal leading to reduction of said holdfast force; said sensor being mounted below a bottom portion of said holdfast beam and spaced from said effective surface, said effective surface coming into contact with the material to be cut; an effective distance between said sensor and said effective surface of said holdfast beam being equal to a distance between a lower edge of said holdfast beam and an upper edge of the stack of material to be cut at which said holdfast force is reduced.

2. An arrangement as defined in claim 1, wherein said sensor is positioned outside said bench.

3. An arrangement as defined in claim 1, wherein said sensor includes one component at one end of said holdfast beam and another component at another end of said holdfast beam.

4. An arrangement as defined in claim 1, wherein said sensor is a light barrier with a source of light and a photocell.

5. An arrangement for cutting stacked sheets of material, comprising: a bench with a planar surface for supporting the material to be cut to rest on, a mechanism that advances the material to be cut; a hydraulically actuated holdfast beam with a holdfast force and an effective surface descending onto the material to be cut; a cutter traveling perpendicular to the surface of said bench adjacent to said holdfast beam; a plurality of sensors mounted in a guillotine bent that the holdfast beam travels up and down in at various distances from the surface of the bench; at least one of said sensors operating during a cutting operation in conjunction with a circuit controlling said holdfast beam and emitting when in operation a signal leading to reduction of said holdfast force; each of said sensors acting parallel to the planar surface of the bench for determination of a current level of an upper edge of the stack of material to be cut and of a lower edge of said holdfast beam relative to the surface of the bench by said sensors; said holdfast force being reduced at a definite-distance level of non-actuated sensors.

6. An arrangement as defined in claim 5, wherein said sensors are light barriers.

* * * * *